US006500786B1

(12) United States Patent
Hartley et al.

(10) Patent No.: US 6,500,786 B1
(45) Date of Patent: Dec. 31, 2002

(54) LUBRICATING OIL COMPOSITION

(75) Inventors: Rolfe J. Hartley, Cranbury, NJ (US); Malcolm Waddoups, Westfield, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/991,962

(22) Filed: Nov. 26, 2001

(51) Int. Cl.[7] ..... C10M 141/10; C10M 141/12

(52) U.S. Cl. ..... 508/365; 508/371; 508/372; 508/375; 508/391

(58) Field of Search ..... 508/365, 371, 508/372, 375, 391

(56) References Cited

U.S. PATENT DOCUMENTS

| | | | | |
|---|---|---|---|---|
| 4,164,473 A | | 8/1979 | Coupland et al. | 252/32.7 E |
| 4,176,073 A | | 11/1979 | Ryer et al. | 252/32.7 E |
| 4,176,074 A | | 11/1979 | Coupland et al. | 252/32.7 E |
| 4,192,757 A | | 3/1980 | Brewster | 252/32.7 E |
| 4,201,683 A | | 5/1980 | Brewster | 252/32.7 E |
| 4,248,720 A | | 2/1981 | Coupland et al. | 252/42.7 |
| 4,289,635 A | | 9/1981 | Schroeck | 252/32.7 E |
| 4,479,883 A | | 10/1984 | Shaub et al. | 252/32.7 E |
| 4,648,985 A | * | 3/1987 | Thorsell et al. | 508/376 |
| 5,346,635 A | | 9/1994 | Khorramian | 252/33.3 |
| 5,356,547 A | * | 10/1994 | Arai et al. | 508/376 |
| 5,439,605 A | | 8/1995 | Khorramian | 252/33.3 |
| 6,063,741 A | * | 5/2000 | Naitoh et al. | 508/365 |
| 6,074,993 A | * | 6/2000 | Waddoups et al. | 508/364 |
| 6,207,625 B1 | * | 3/2001 | Ogano et al. | 508/365 |
| 6,300,291 B1 | * | 10/2001 | Hartley et al. | 508/363 |
| 6,329,328 B1 | * | 12/2001 | Koganel et al. | 508/365 |

FOREIGN PATENT DOCUMENTS

| | | | |
|---|---|---|---|
| EP | 0 855 437 A1 | 7/1998 | C10M/135/18 |
| WO | WO96/37582 | 11/1996 | C10M/135/18 |

* cited by examiner

*Primary Examiner*—Jacqueline V. Howard

(57) ABSTRACT

Lubricating oil compositions exhibititing improved low temperature valve train wear performance with a lowered phosphorus content, which contain a reduced amount of a metal hydrocarbyl dithiophosphate, a molybdenum compound, a metal-free friction modifier and a phosphorus-free antioxidant.

19 Claims, No Drawings

LUBRICATING OIL COMPOSITION

The present invention relates to lubricating oil compositions. More particularly, the present invention relates to lubricating oil compositions, which exhibit improved low temperature valve train wear performance with reduced phosphorus content.

BACKGROUND OF THE INVENTION

Lubricating oil compositions used to lubricate internal combustion engines contain base oil of lubricating viscosity, or a mixture of such oils, and additives used to improve the performance characteristics of the oil. For example, additives are used to improve detergency, reduce engine wear, to provide stability against heat and oxidation, to reduce oil consumption, to inhibit corrosion, to act as a dispersant, and reduce friction loss. Some additives provide multiple benefits, such as a dispersant/viscosity modifier. Other additives, while improving one characteristic of the lubricating oil, have an adverse effect on other characteristics. Thus, to provide a lubricating oil having optimal overall performance, it is necessary to characterize and understand all the effects of the various additives available, and carefully balance the additive content of the lubricant.

To provide improved low temperature valve train wear performance, conventional lubricants are formulated with an antiwear additive. Metal hydrocarbyl dithiophosphates, particularly zinc dialkyldithiophosphates (ZDDP), are the primary antiwear additive used in lubricating oils for internal combustion engines. ZDDP provides excellent wear protection at a comparatively low cost and also functions as an antioxidant. However, there is some evidence that phosphorus in lubricants can shorten the effective life of automotive emission catalysts. Accordingly, industry has limited the amount of phosphorus that lubricants can contain. The current industry category (ILSAC GF-3) mandates a lubricant phosphorus limit of 1000 ppm. It is possible that the next category of service fill oils in the United States will mandate even more stringent limits, such as a maximum phosphorus content of no more than 600 ppm, or even 500 ppm.

Concurrently, there has been a move to higher quality (including hydrocracked and synthetic) base oils which have lower sulfur content, lower wax content and reduced volatility. These oils, due to a higher natural viscosity index, provide improved lubricant performance and low temperature characteristics.

To meet these emerging requirements, it would therefore be advantageous to provide lubricating oils, particularly lubricating oils formulated with base oils having relatively high viscosity indices and low volatilities for improved fuel economy, that also provide excellent low temperature valve train wear performance with reduced amounts of phosphorus-containing antiwear additives.

U.S. Pat. Nos. 5,346,635 and 5,439,605 describe lubricating oils completely free of phosphorus-containing antiwear additives containing a complex blend of ashless friction reducers, ashless antiwear/extreme pressure additives, antioxidants, metal detergents and polymeric viscosity modifiers and flow improvers, which compositions purportedly provide acceptable properties. These compositions may also contain a molybdenum-containing additive, as a friction modifier.

Each of WO 96/37,582 and EP 0 855 437 describe lubricating oil formulations that contain, in addition to other specified and required additives, an amount of ZDDP that may provide 600 ppm or less of phosphorus, together with a molybdenum-based friction modifier.

It has been proposed in many patents and articles (for example, U.S. Pat. Nos. 4,164,473; 4,176,073; 4,176,074; 4,192,757; 4,248,720; 4,201,683; 4,289,635; and 4,479,883) that oil soluble molybdenum compounds are useful as lubricant additives. In particular, molybdenum compounds provide enhanced fuel economy in gasoline or diesel fueled engines (spark- and compression-ignited engines, respectively), including both short and long term fuel economy (i.e., fuel economy retention properties).

It has now been found that by adding even a small amount of these molybdenum compounds to a lubricating oil, excellent low temperature valve train wear performance can be achieved with reduced levels of ZDDP. Thus, lubricating oils providing excellent low temperature valve train wear performance can be formulated with reduced levels of phosphorus can be provided.

The present invention also provides many additional advantages that shall become apparent as described below.

SUMMARY OF THE INVENTION

In accordance with first aspect of the invention, there is provided a lubricating oil composition providing excellent low temperature valve train wear performance, which composition comprises at least one oil of lubricating viscosity, at least one molybdenum compound in an amount sufficient to provide the composition with at least 50 ppm by mass, of molybdenum; a phosphorus-free antioxidant and a metal-free friction modifier, which composition contains an amount of ZDDP that contributes no more than 600 ppm of phosphorus to the lubricating oil composition.

In accordance with a second aspect of the invention, there is provided a lubricating oil composition as described in the first aspect of the invention, wherein the oil of lubricating viscosity has a viscosity of between about 4.0 $mm^2$/sec and 5.5 $mm^2$/sec at 100° C. and/or the lubricating oil composition (the fully formulated oil) has a NOACK volatility of no more than 15 wt. %.

In accordance with a third aspect of the invention, there is provided a lubricating oil composition as described in the first aspect of the invention, wherein the antioxidant is present in an amount effective to achieve a MHT-4 TEOST result of no more than 45 mg. of deposit.

In accordance with a fourth aspect of the invention, there is provided a lubricating oil composition as described in the first aspect of the invention, wherein the metal-free friction modifier is present in an amount effective to achieve a pass in a Sequence VIB fuel economy test.

In accordance with a fifth aspect of the invention, there is provided a lubricating oil composition as described in the first aspect of the invention, which further contains an overbased metallic detergent.

In accordance with another aspect of the invention, described is the use of a molybdenum compound to provide improved low temperature valve train wear performance to a lubricating oil composition containing a metal hydrocarbyl dithiophosphate in an amount introducing no more than 600 ppm of phosphorus into the composition, a metal-free friction modifier and a phosphorus-free antioxidant.

Other and further aspects, objects, advantages and features of the present invention will be understood by reference to the following specification.

DESCRIPTION OF THE PREFERRED EMBODIMENTS

The lubricating compositions of the present invention contain an oil of lubricating viscosity, an amount of a metal hydrocarbyl dithiophosphate, particularly ZDDP, and an amount of a molybdenum compound sufficient to provide the composition with at least 50 ppm by mass of molybdenum. An amount of about 50 ppm to 350 ppm by mass of molybdenum from a molybdenum compound has been found to be effective as an auxiliary antiwear agent in combination with reduced levels of ZDDP. Specifically, a molybdenum compound, in an amount providing from 50 ppm to 200 ppm by mass has been found to be sufficient to provide antiwear characteristics to formulations containing ZDDP in amounts introducing from about 500 to 600 ppm by mass into the composition.

With reduced amounts of ZDDP, molybdenum compounds have been found to provide insufficient fuel economy/friction modifying characteristics and compositions containing, in combination, a molybdenum compound and a reduced amount of ZDDP may not provide a reliable pass of a Sequence VIB fuel economy test. Metal-free friction modifiers have been found to provide excellent fuel economy results in systems containing reduced amounts of ZDDP.

Molybdenum compounds are expensive compared to ZDDP. In the total absence of ZDDP, far more of the molybdenum compound (e.g., an amount providing about 800 ppm to 1000 ppm by mass of Mo) is required to provide adequate low temperature valve train wear performance (as measured by a Sequence IVA test).

Thus, to provide a low cost, commercially acceptable product providing excellent overall properties, the lubricating oil compositions of the present invention comprise oil of lubricating viscosity, an amount of ZDDP, preferably an amount providing 100 to 600, such as 100 to 500 ppm by mass of phosphorus; a molybdenum compound in an amount providing the composition with from about 50 ppm to 200 ppm by mass of molybdenum; an effective amount of phosphorus-free antioxidant and an effective amount of metal-free friction modifier.

The oil of lubricating viscosity useful in the context of the present invention is selected from the group consisting of Group I, Group II, or Group III, Group IV or Group V base stocks or base oil blends of the aforementioned base stocks. Generally, the viscosity of such oils ranges from about 2 $mm^2$/sec (centistokes) to about 40 $mm^2$/sec at 100° C. Preferred are base stocks or base stock mixtures having an intrinsic viscosity of from about 4.0 to about 5.5 mm2/sec at 100° C. Further preferable are base stocks and base stock mixtures having a volatility, as measured by the NOACK test (measured by determining the evaporative loss in mass percent of an oil after 1 hour at 250° C. according to the procedure of ASTM D5880), of less than 15%, more preferably less than 12%, most preferably less than 10%. The most preferred oils for both fuel economy retention and low temperature valve train antiwear performance are:

(a) Base oil blends of Group III, IV or V base stocks with Group I or Group II base stocks, where the combination has a viscosity index of at least 110; and (b) Group III, IV or V base stocks or base oil blends of more than one Group III, IV and/or V base stock, where the viscosity index is between about 120 to about 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a.) Group I base stocks contain less than 90 percent saturates and/or greater than 0.03 percent sulfur and have a viscosity index greater than or equal to 80 and less than 120 using the test methods specified in Table E-1.

b.) Group II base stocks contain greater than or equal to 90 percent saturates and less than or equal to 0.03 percent sulfur and have a viscosity index greater than or equal to 80 and less than 120 using the test methods specified in Table E-1.

c.) Group III base stocks contain greater than or equal to 90 percent saturates and less than or equal to 0.03 percent sulfur and have a viscosity index greater than or equal to 120 using the test methods specified in Table E-1.

d.) Group IV base stocks are polyalphaolefins (PAO).

e.) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

For the lubricating oil compositions of this invention, any suitable soluble organo-molybdenum compound having anti-wear properties in lubricating oil compositions having reduced phosphorus contents may be employed. As an example of such soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

The molybdenum compound may be mono-, di-, tri- or tetra-nuclear. Dinuclear and trinuclear molybdenum compounds are preferred. The molybdenum compound is preferably an organo-molybdenum compound. More preferably, the molybdenum compound is selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof. Most preferably, the molybdenum compound is present as molybdenum dithiocarbamate or a trinuclear organo-molybdenum compound.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4$$

and $$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1

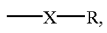

2

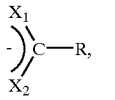

3

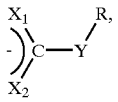

4

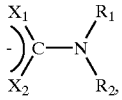

and

5

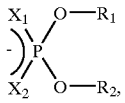

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ to have cationic cores surrounded by anionic ligands and are represented by structures such as

6

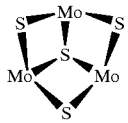

and

7

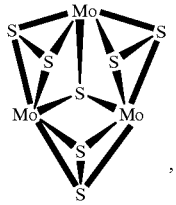

, and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The metal dihydrocarbyl dithiophosphate antiwear agents comprise dihydrocarbyl dithiophosphate metal salts wherein the metal may be an alkali or alkaline earth metal, or aluminum, lead, tin, molybdenum, manganese, nickel or copper. The zinc salts are most commonly used in lubricating oil. Although the present specification hereafter makes express mention of ZDDP, dihydrocarbyl dithiophosphate metal salts based on these other metals should be considered equivalent.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

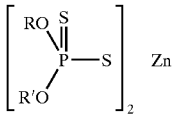

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The zinc dialkylthiophosphate compound can be primary zinc, secondary zinc, or mixtures thereof.

ZDDP is conventionally added to lubricating oil compositions in amounts of from about 1.1 to 1.3 wt. %, based upon the total weight of the lubricating oil composition. This "conventional" amount of ZDDP introduces approximately 1000 ppm by mass of phosphorus into the lubricating oil composition. To provide the antiwear advantages of ZDDP but limit phosphorus to a maximum of 600 ppm by mass, the amount of ZDDP should limited to an amount of from 0.1 to about 0.75 wt. %, based on the total weight of the lubricating oil composition (finished oil). To limit phosphorus to a maximum of 500 ppm by mass, the amount of ZDDP should limited to an amount of from 0.1 to about 0.6 wt. %, based on the total weight of the finished oil.

Metal-free friction modifiers useful as auxiliary friction modifiers include aminic and organic friction modifiers. Aminic friction modifiers include oil-soluble alkoxylated mono- and di-amines, which improve boundary layer lubrication. One class of metal free friction modifier comprises ethoxylated amines. The amines may be used as such or in the form of an adduct or reaction product with a boron compound such as a boric oxide, boron halide, metaborate, boric acid or a mono-, di- or tri-alkyl borate. Organic friction modifiers are also known and useful in the lubricating oils of the present invention. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26. The organic friction modifier is included in the lubricating oil compositions of the present invention in an amount effective to allow the composition to reliably pass a Sequence VIB fuel economy test. For example, the metal-free friction modifier may be added to the lubricating oil composition in an amount sufficient to obtain a retained fuel economy improvement of at least 1.7% for an SAE 5W-20 lubricant, 1.1% for a 5W-30 lubricant, and 0.6% for a 10W-30 lubricant as measured at 96 hours (Phase II performance) in the ASTM Sequence VIB Fuel Economy Test.

In addition to providing antiwear protection, ZDDP provides an antioxidant credit. Similarly, in addition to the now recognized ability to provide antiwear protection, molybdenum compounds may provide antioxidant credits. When minimizing the amount of both the ZDDP and molybdenum-containing compound, one or more auxiliary antioxidants (which are also relatively inexpensive compared to the molybdenum-containing compound) may be required. Thus, a preferred lubricating oil composition in accordance with the present invention may contain dihydrocarbyl dithiophosphate metal salts (e.g., ZDDP) in an amount that introduces up to about 600 ppm (or about 500 ppm) of phosphorus into the finished lubricant, a molybdenum compound in an amount providing the finished lubricant with from about 100 ppm to about 200 ppm of molybdenum, an organic friction modifier in an amount sufficient to allow the finished lubricant to pass the Sequence VIB fuel economy test and a phosphorus-free antioxidant in an amount effective to allow the finished lubricant to achieve a reliable pass in a MHT-4 TEOST test.

Phosphorus-free oxidation inhibitors suitable for use in the present invention include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, metal thiocarbamates and oil soluble copper compounds as described in U.S. Pat. No. 4,867,890.

Aromatic amines having at least two aromatic groups attached directly to the nitrogen constitute another class of compounds that is frequently used for antioxidancy. While these materials may be used in small amounts, preferred embodiments of the present invention are free of these compounds. Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 wt. % active ingredient. When needed, the use of at least one of a hindered phenol and aromatic amine antioxidant, or in combination thereof, is preferred. The phosphorus-free antioxidant is present in an amount effective to allow the finished lubricant to achieve a reliable pass in a MHT-4 TEOST test. An amount effective is considered an amount effective to allow the finished lubricant to achieve a MHT-4 TEOST result of no more than 45 mg of deposit.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such a such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Known detergents include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

In the present invention, overbased detergents are preferred, and when used, are used at about 0.5% to 5% weight percent based on the total weight of the composition. The total base number of the overbased sulfonate detergent is preferably between about 150 to 450. Further preferably, the overbased detergent is overbased calcium sulfonate. This is preferably added in an amount providing between about 0.112 to 0.42 weight percent of calcium from calcium sulfonate, or between about 0.7 to 3.0 weight percent of calcium sulfonate in oil, more preferably between about 1.0 to 3.0 weight percent of calcium sulfonate in oil.

Polyisobutenyl succinic anhydride (PIBSA) improves compatability between colloidal detergents and other additives, and provides enhanced water compatability. Therefore it is advantageous to provide lubricating oil compositions with a minor amount of PIBSA.

Additional additives may be incorporated into the compositions of the invention to enable particular performance requirements to be met. Examples of additives which may be included in the lubricating oil compositions of the present invention are dispersants, metal rust inhibitors, viscosity index improvers, corrosion inhibitors, oxidation inhibitors, anti-foaming agents, and pour point depressants. Some are discussed in further detail below.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene. Multifunctional viscosity modifiers that further function as dispersants are also known.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package with the remainder being base stock. The compositions can be used in the formulation of crankcase lubricating oils (i.e., passenger car motor oils, heavy duty diesel motor oils, and passenger car diesel oils) for spark-ignited and compression-ignited engines.

This invention will be further understood by reference to the following examples, wherein all parts are parts by weight, unless otherwise noted and which include preferred embodiments of the invention.

EXAMPLES

Lubricating oil formulations meeting 5W30 specifications were prepared comprising Group II base oil, dispersant, overbased detergent, organic friction modifier, phenolic antioxidant, viscosity modifier and antifoamant. To each formulation there was added either ZDDP or a combination of ZDDP and a molybdenum compound (molybdenum dithiocarbamate (MoDTC)). The ZDDP was added in an amount providing a substantially constant phosphorus level of about 500 ppm. The samples were compared in a Sequence IVA wear test, in which a borderline pass is a wear measurement of 120 microns. The results are shown in Table 1.

TABLE 1

| Example | 1 | 2 | 3 | 4 | 5 | 6 |
|---|---|---|---|---|---|---|
| ZDDP1, mass % | 0.58 | 0.58 | 0.29 | 0.29 | 0.00 | 0.00 |
| ZDDP2, mass % | 0.00 | 0.00 | 0.29 | 0.29 | 0.58 | 0.58 |
| MoDTC, mass % | 0.20 | 0.00 | 0.20 | 0.00 | 0.20 | 0.00 |
| NOACK, mass % | 14.6 | 14.9 | 14.7 | 15.0 | 14.9 | 13.7 |
| Mo, ppm | 110 | 0 | 110 | 0 | 110 | 0 |
| P, ppm | 480 | 458 | 463 | 480 | 455 | 470 |
| Av. Cam Wear, microns | 20 | 110.2 | 51.61 | 186.4 | 59.82 | 246.5 |

ZDDP1: primary and secondary alkyl groups
ZDDP2: all primary alkyl groups

As shown by the data, ZDDP containing secondary alkyl groups is superior to ZDDP that contains only primary alkyl groups. At levels providing the lubricant composition with about 500 ppm of phosphorus, even the composition containing the ZDDP having secondary alkyl groups provides only a borderline pass in the Sequence IVA wear test. The addition of only a small amount of a molybdenum compound (Examples 1, 3 and 5) provide a robust pass of the Sequence IVA wear test, regardless of which ZDDP is used. Wear is shown to be reduced, by about a factor of two, in the presence of the molybdenum compound.

The addition of an even greater amount of the molybdenum compound provides further improvements in wear. Example 7 contained a slightly higher amount of ZDDP (which again provided about 500 ppm of P) and molybdenum, but was otherwise identical to Example 1. Example 8 demonstrates that no ZDDP is required to pass the Sequence IVA test, but that to do so a far greater amount of the molybdenum compound is required. The composition of Examples 7 and 8, and the results achieved are shown in Table 2.

TABLE 2

| Example | 7 | 8 |
|---|---|---|
| ZDDP1, mass % | 0.00 | 0.00 |
| ZDDP2, mass % | 0.64 | 0.00 |
| MoDTC, mass % | 0.40 | 1.5 |
| NOACK, mass % | 14.1 | 14.1 |
| Mo, ppm | 210 | 813 |
| P, ppm | 488 | 0 |
| Av. Cam Wear, microns | 18.14 | 30.21 |

Examples 9 and 10 are identical, except that Example 9 contained 930 ppm phosphorus and Example 10 contained only 465 ppm phosphorus from ZDDP. The difference in TEOST performance between the two samples was 40 mg., as shown in Table 3.

TABLE 3

| Example | 9 | 10 |
|---|---|---|
| ZDDP1, mass % | 0.58 | 0.58 |
| ZDDP2, mass % | 0.58 | 0.00 |
| MoDTC, mass % | 0.30 | 0.30 |
| NOACK, mass % | 13.1 | 12.8 |
| Mo, ppm | 170 | 170 |
| P, ppm | 930 | 465 |
| MMHT-4 TEOST, mg. | 59.1 | 103.0 |

Examples 11 through 14 demonstrate that the use of a supplemental antioxidant provides the low-phosphorus (less than 500 ppm), low molybdenum (100 ppm) formulations with a passing TEOST score (less than or equal to 45 mg of deposit). AO1 was a diphenylamine-type antioxidant. AO2 was a hindered phenolic antioxidant. Results are shown in Table 4.

TABLE 4

| Example | 11 | 12 | 13 | 14 |
|---|---|---|---|---|
| ZDDP1, mass % | 0.29 | 0.29 | 0.29 | 0.29 |
| ZDDP2, mass % | 0.29 | 0.29 | 0.29 | 0.29 |
| MoDTC, mass % | 0.20 | 0.20 | 0.20 | 0.20 |
| AO1, mass % | 0.00 | 0.20 | 0.40 | 0.60 |
| AO2, mass % | 0.00 | 0.20 | 0.40 | 0.60 |
| NOACK, mass % | 10.4 | 10.5 | 10.2 | 10.5 |
| Mo, ppm | 110 | 110 | 110 | 110 |
| P, ppm | 459 | 457 | 464 | 460 |
| MHT-4 TEOST, mg. | 71 | 59.8 | 62.30 | 43.0 |

The Sequence IVA test for wear, the Sequence VIB test for fuel economy and the MHT-4 TEOST test for oxidation stability are all described in ASTM D4485, the content of which is hereby incorporated herein, in its entirety, by reference. The amount of phosphorus and molybdenum in the lubricating oil composition is measured according to ASTM D5185, the content of which is hereby incorporated herein, in its entirety, by reference. The disclosures of all patents, articles and other materials described herein are also hereby incorporated, in their entirety, into this specification by reference.

It should be noted that the lubricating oil compositions of this invention comprise defined, individual, i.e., separate, components that may or may not remain the same chemically before and after mixing. Thus, it will be understood that various components of the composition, essential as well as optional and customary, may react under the conditions of formulation, storage or use and that the invention also is directed to, and encompasses, the product obtainable, or obtained, as a result of any such reaction.

The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricating oil composition comprising a major amount of oil of lubricating viscosity, an oil soluble molybdenum compound in an amount providing from about 50 ppm to about 350 ppm, by mass, of molybdenum to said composition, an amount of metal hydrocarbyl dithiophosphate providing said composition with no more than 600 ppm, by mass, of phosphorus, an effective amount of at least one metal-free friction modifier and an effective amount of at least one phosphorus-free antioxidant.

2. The lubricating oil composition of claim 1, wherein said metal hydrocarbyl dithiophosphate is zinc dialkyl dithiophosphate.

3. The lubricating oil composition of claim 1, wherein said composition has a NOACK volatility of no greater than 15 wt. %.

4. The lubricating oil composition of claim 3, wherein said composition has a NOACK volatility of no greater than 12 wt. %.

5. The lubricating oil composition of claim 4, wherein said composition has a NOACK volatility of no greater than 10 wt. %.

6. The lubricating oil composition of claim 1, wherein said oil of lubricating viscosity has a viscosity between 4.0 $mm^2$/sec and 5.5 $mm^2$/sec at 100° C.

7. The lubricating oil composition of claim 1, wherein said oil of lubricating oil composition is a Group II oil, a Group III oil, a Group IV oil, a Group V oil or a mixture thereof, or is a mixture of a Group I oil and at least one of a Group II oil, a Group III oil, a Group IV oil, or a Group V oil.

8. The lubricating oil composition of claim 1, wherein said oil of lubricating viscosity comprises a Group IV oil.

9. The composition of claim 1, wherein said molybdenum compound is an organo-molybdenum compound.

10. The composition of claim 9, wherein said organo-molybdenum compound is molybdenum dithiocarbamate.

11. The composition of claim 1, wherein said at least one phosphorus-free antioxidant comprises a hindered phenol antioxidant, an aromatic amine antioxidant, or a mixture thereof.

12. The composition of claim 1, wherein said at least one phosphorus-free antioxidant is present in an amount sufficient to allow said composition to achieve a MHT-4 TEOST result of less than or equal to 45 mg of deposit.

13. The composition of claim 1, further comprising at least one overbased metallic detergent.

14. The composition of claim 13, wherein said at least one overbased metallic detergent is an overbased calcium detergent.

15. The composition of claim 1, wherein said metal hydrocarbyl dithiophosphate provides said composition with no more than 500 ppm, by mass, of phosphorus.

16. The composition of claim 1, wherein said metal hydrocarbyl dithiophosphate provides said composition with from 100 to 600 ppm, by mass, of phosphorus.

17. The composition of claim 15, wherein said metal hydrocarbyl dithiophosphate provides said composition with from 100 to 500 ppm, by mass, of phosphorus.

18. A lubricating oil concentrate comprising oil of lubricating viscosity, an oil soluble molybdenum compound in an amount providing from about 50 ppm to about 350 ppm, by mass, of molybdenum to a fully formulated oil, metal hydrocarbyl dithiophosphate in an amount providing said fully formulated oil with no more than 600 ppm, by mass, of phosphorus, a metal-free friction modifier and a phosphorus-free antioxidant.

19. A method of providing wear protection to an internal combustion engine in use, and reducing the poisoning of the catalyst of the engine emission system, said method comprising lubricating said engine with a lubricating oil composition as claimed in claim 1.

* * * * *